United States Patent [19]

Richards

[11] 4,221,280

[45] Sep. 9, 1980

[54] BI-ELEVATIONAL PLATFORM LIFT

[75] Inventor: Lawrence I. Richards, Elk Grove Village, Ill.

[73] Assignee: Advance Lifts, Incorporated, St. Charles, Ill.

[21] Appl. No.: 902,936

[22] Filed: May 5, 1978

[51] Int. Cl.[3] ..... B66B 11/04

[52] U.S. Cl. ..... 187/18; 254/122

[58] Field of Search ..... 187/18, 8.71, 8.72; 182/141, 148, 63, 69; 254/122, 3 R; 214/512

[56] References Cited

U.S. PATENT DOCUMENTS

| | | | |
|---|---|---|---|
| 2,501,001 | 3/1950 | Neely | 254/122 |
| 3,476,016 | 11/1969 | Dixon et al. | 187/18 |
| 3,628,771 | 12/1971 | Egeland | 187/18 |
| 3,891,108 | 6/1975 | Traficant | 254/122 |

*Primary Examiner*—Robert J. Spar
*Assistant Examiner*—Kenneth Noland
*Attorney, Agent, or Firm*—Lester N. Arnold

[57] ABSTRACT

A dockside cargo-handling platform lift apparatus is provided to be adjustable to desired vertical elevations through conventional scissor-action expandable support framework driven by hydraulic actuation power, and is improved to further include a pivotably mounted top deck platform surface which is adjustable to desired angular elevations through a pivotable support framework driven by hydraulic actuation power to move against a free end portion of the platform surface.

4 Claims, 6 Drawing Figures

BI-ELEVATIONAL PLATFORM LIFT

BACKGROUND AND SUMMARY OF THE INVENTION

This invention relates to dock positional platforms or elevators of the vertical lift and descent type as employed in heavy-duty loading applications, and more particularly, relates to an improved bi-elevational platform adjustable for both vertical lift positions and angular lift positions.

It is common practice to employ so-called heavy-duty vertically adjustable scissor-action platforms or elevators in the dockside handling of cargos and dead loads. These vertical platforms are conventionally actuated by hydraulic cylinders directly attached to the platform which can be selectively actuated to control the vertical lift and descent either under load or without load. In particular applications for dockside handling of cargo or bulk loads, it becomes more desirable to provide that the platform be made to ascribe an angle of lift as referenced from the horizontal. The stationary angular position therefore is more convenient in lieu of providing many lifts and descents over a relatively small vertical height, as compared to the maximum vertical lift capacity of the platform.

Platforms are then provided which move vertically while maintaining a level horizontal loading surface and platforms are also provided which are positioned to assume a desired angle of deviation from the horizontal wherein the loading surfaces are so-angled. However, it is thought that heretofore it has not been common practice to provide such a loading elevator optionally featuring both vertical lift positions and angular lift positions, hereinafter sometimes referred to as bi-elevational or dual positional platforms.

The present invention provides improved bi-elevational platform lift apparatus comprised of base structure means, movable platform structure means, intermediately disposed scissor-acting or criss-crossed expandable first support structure means, first hydraulic actuator power means attachable to the first support structure means and being effective through hydraulic cylinder expansion to cause scissor-action expansion from a closed position of the first support structure means and resulting vertical movement of the platform structure means, second support structure means pivotably attached to the first support structure means and having the free end portion thereof movable against the platform structure means with the first support structure means in said closed position, and second hydraulic actuator power means attachable to the second support structure means and being effective through hydraulic cylinder expansion to cause pivotable movement of the second support structure means against the platform structure means resulting in angular movement thereof.

It is therefore an object of the present invention to provide an improved bi-elevational platform lift movable to desired vertical lift and descent positions and desired angular lift and descent positions.

It is another object of the invention to provide separately actuable support structure means to provide either vertical lift adjustments or angular lift adjustments.

It is yet another object to provide conventional scissor-action support structure means powered by hydraulic cylinder means to accomplish vertical lift and descent movements of the platform structure means.

It is still another object to provide improved pivotable support structure means powered by hydraulic cylinder means to accomplish angular lift and descent movements of the platform structure means.

It is a further object to provide angular lift movements of the platform structure means with the scissor-action support structure means in a fully closed or collapsed position thereof.

It is still further object of the invention to provide that the pivotable support structure means has its free end portion engageable with and movable against a selected edge portion of the platform structure means to effect selective lifting thereof with respect to an oppositely disposed edge portion thereof.

DESCRIPTION OF THE PREFERRED EMBODIMENT

Figure 1:
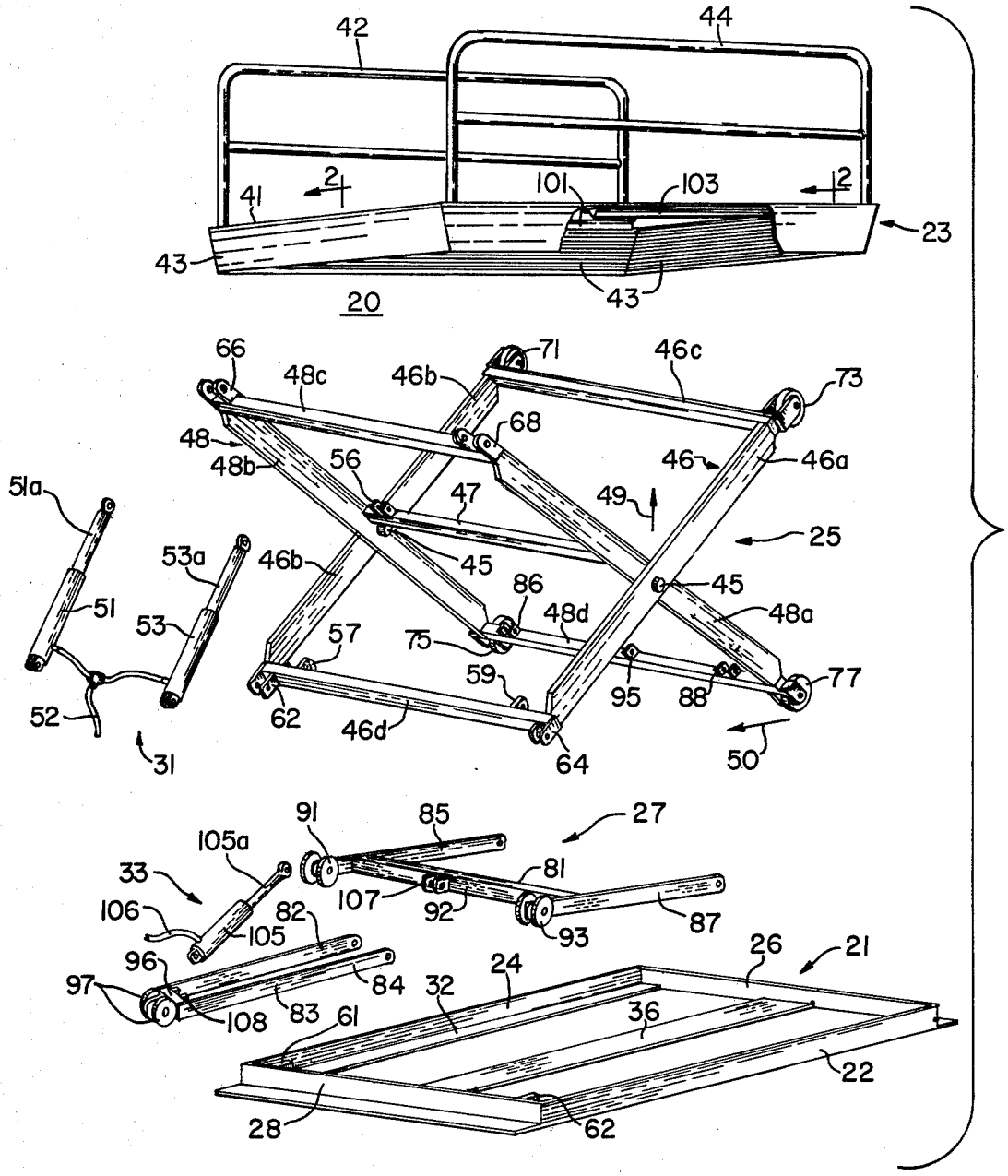
FIG. 1 is an exploded disassembled perspective view of the improved bi-elevational platform lift in accordance with the invention showing both conventional scissor-action support structure and improved separately actuable pivotable support structure.

There is shown in FIG. 1 an improved bi-elevational platform lift apparatus or assembly 20 primarily comprised of base structure means 21, topmost platform structure means 23, and intermediately disposed scissor-acting or criss-crossed first support frame means or structure means 25 and pivotable second support frame means or structure means 27. The first support structure means 25 is expandable from a fully closed or collapsed position thereof as shown in the drawing to a fully extended or raised vertical position thereof as shown in FIG. 1. The expansion or vertical lift of the first support structure means 25 is effected by conventional first hydraulic cylinder power means 31. The pivotable second support structure means 27 is actuable for angular variations by second hydraulic cylinder power means 33.

The base structure means 21 comprises a foundation structure for the platform lift 20 and includes a heavy-duty framework defined by a pair of side frame members 22 and 24 and end frame members 26 and 28. Adjacently and interiorly positioned to the pair of side frame members 22 and 24 are a pair of flatlike bed frame members 32 and 34, respectively (only the member 32 being clearly shown in FIG. 1). A generally centrally disposed flatlike bed frame member 36 is also provided, the purposes of the bed frame members being to comprise flatlike surfaces upon which to engage certain rollers of the movable first and second support structure means 25 and 27. The base structure means 21 can be mounted upon any desired surface as is the common practice in the pertinent art.

The platform structure means 23 comprises a loading structure providing a top or upper loading surface 41 as might be aligned with raised docksides for cargo loading and unloading, and inwardly and downwardly depending side walls 43 forming a four-sided side frame underlying the loading surface 41. Optionally, portions of the side walls 43 can be made to hinge therefrom. The inwardly sloping or beveled side frame is known to be common practice to provide a safety feature wherein slightly inwardly protruding objects (foot), with reference to the distal edge portion of the loading surface 41, are forcedly expelled without crushing or severing. For example, it is common to provide that the entire platform lift 20 would be received in a foundational recess (not shown in the drawing) when in its closed or collapsed position so as to present the loading surface 41 flush with the upper foundational surface. The platform structure means 23 is conveniently shown to include a pair of optional guard or side rails 42 and 44.

There is shown generally throughout the drawings a scissor-acting or criss-crossed support framework, hinged together to pivot about a centrally positioned pivot pin 45, and which framework comprises the first support frame means or structure means 25. The support framework includes a first enclosed rectangular framework 46 comprised of generally tubular side frame members 46*a* and 46*b* and end frame members 46*c* and 46*d*, and a second enclosed rectangular framework 48 comprised of generally tubular side frame members 48*a* and 48*b* and end frame members 48*c* and 48*d*. As is clearly shown in FIG. 1, the framework 48 is selectively positioned inwardly of and to interleave with the framework 46 in a criss-crossed pattern, and the frameworks 46 and 48 are then joined by the pivot pin 45.

Figure 2:
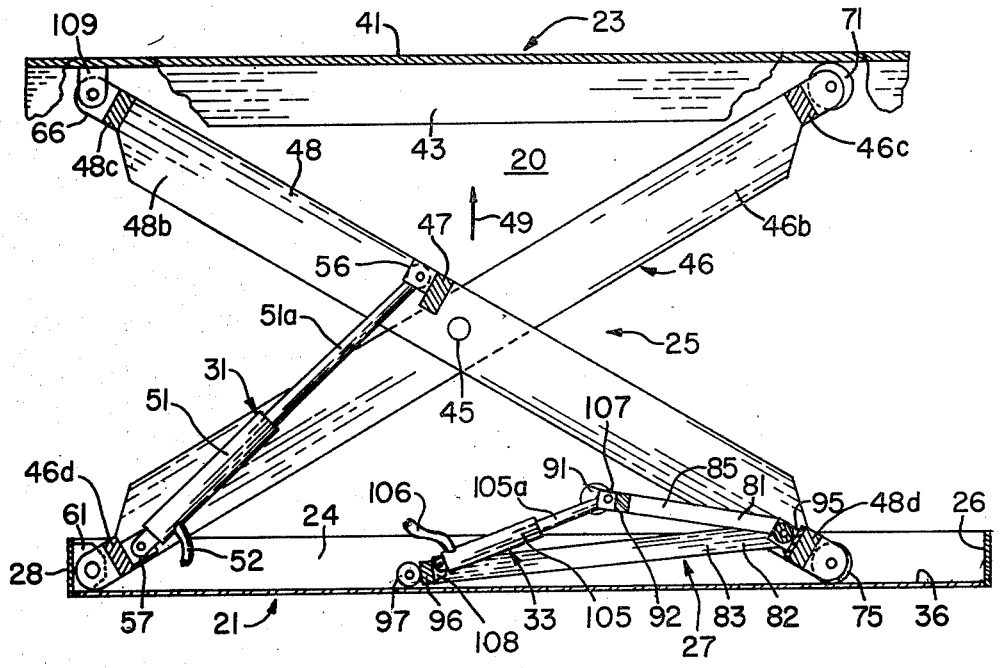
FIG. 2 is a fragmentary sectional side view of the apparatus of FIG. 1 taken generally along the line 2—2 thereof.
Figure 3:
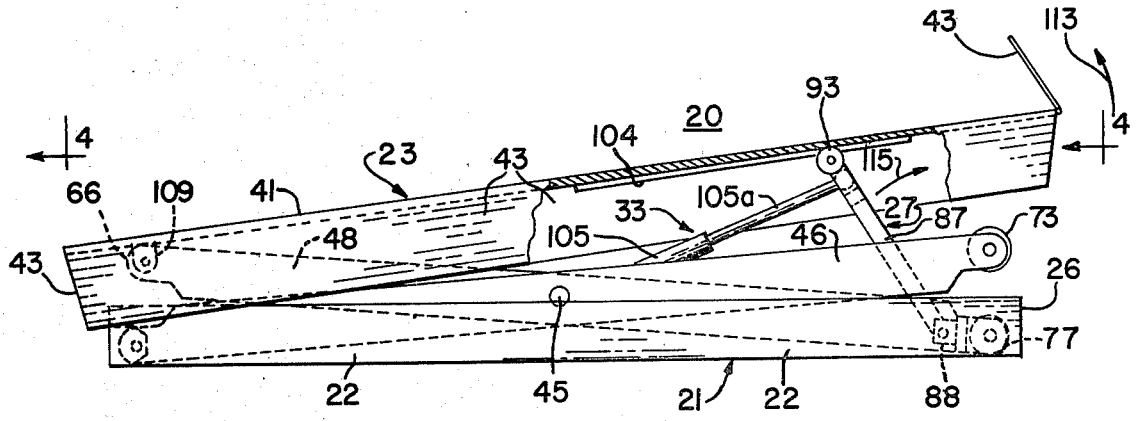
FIG. 3 is a side view of the assembled apparatus of FIG. 1 showing the scissor-action support structure in a closed position and showing the pivotable support structure in pivotable movement against an edge portion of a platform structure to effect angular lift thereof.
Figure 4:
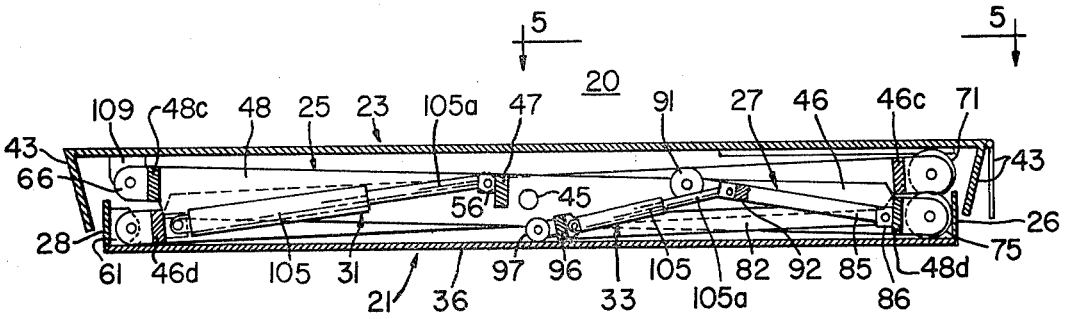
FIG. 4 is generally a sectional side view of the apparatus of FIG. 3 showing the pivotable support structure in the non-actuated position thereof.

The pivoted first support structure means 25 is movable in a conventional manner between a fully closed or collapsed position as shown in FIGS. 3 and 4, defining its lowermost vertical position, and a fully open or expanded position (FIGS. 1 and 2) defining its uppermost or raised vertical position. The first support structure means 25 is moved by the provision of electric controlled hydraulic actuation means including at least a pair of hydraulic cylinder actuators 51 and 53 fed by fluid flow lines 52. The hydraulic actuators 51 and 53 have inner telescopic expansion posts 51*a* and 53*a*, shown fully expanded in FIG. 1. The free end portions of the posts 51*a* and 53*a* are provided to be connected to a cross-frame member 47 of the framework 48 as by pin connections (not shown) to suitable frame bracket means, one of which is clearly shown at 56 of FIG. 1. The opposite end of the hydraulic actuators 51 and 53 are then hinged to bracket post means 57 and 59, respectively.

The expansion and contraction actions of the hydraulic actuators 51 and 53 are well understood in the art to effect controlled platform vertical lift or ascent and platform vertical drop or descent. The detailed description herein does not attempt to disclose either a suitable hydraulic actuation system or the electric circuit controls therefor, since these means are thought to be well understood in the pertinent art. It is readily apparent that the cross-frame member 47 is distally removed along the side frame members 48*a* and 48*b* from the pivot pin 45 to effect a torque force upon the framework 48 working about the pivot pin 45. The stated torque force causes pivotable movement of the framework 48 about its pivotal connection 45, and resulting vertical motion of the pivot pin 45 in the direction of the arrow 49 as the framework 46 is carried therealong. Hence, the platform structure means 23 is movable through means of the first support structure means 25 to predetermined vertical lift and descent elevational positions to define one elevational position of the adjustable bi-elevational platform lift 20.

Figure 5:
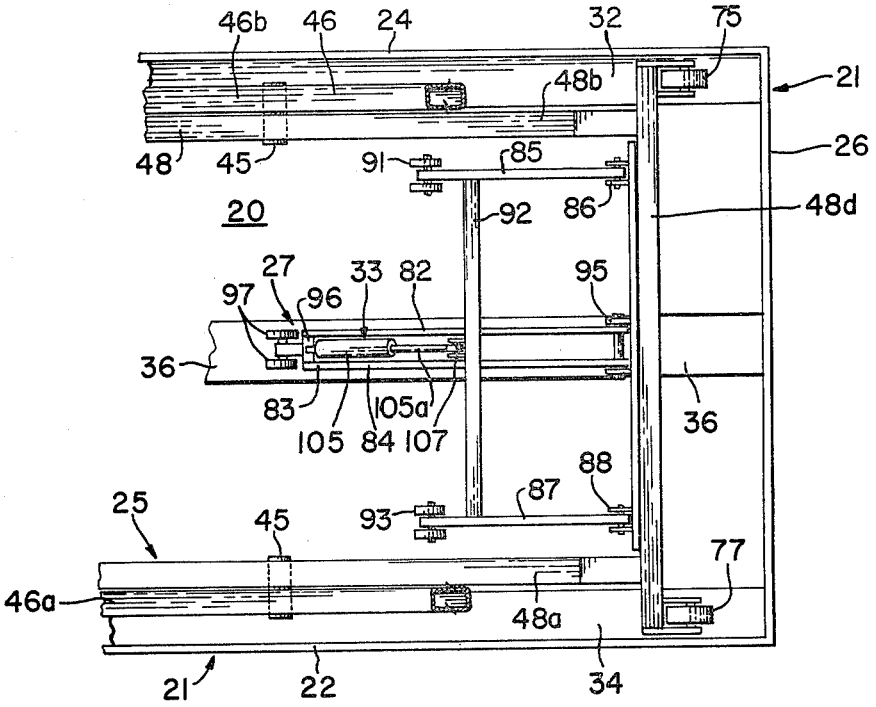
FIG. 5 is a top sectional view of the apparatus of FIG. 4 after having omitted the topmost platform structure for clarity in the assembly of the pivotable support structure.

Simultaneously with vertical movement of the pivot pin 45 and rotational movement between the frameworks 46 and 48, the free end portions of the frameworks 46 and 48 are moved inwardly in the direction of the arrow 50. The fixed end portions of the frameworks 46 and 48 are fixedly determined by pinned pivotal connections to the base structure means 21 and the platform structure means 23, respectively. The base structure means 21 is provided with oppositely disposed bracket post means 61 and 63 to which a pair of spaced bracket means 62 and 64 of the framework 46 are connected by suitable pivot pins, respectively. The framework 48 is similarly provided with a pair of spaced bracket means 66 and 68 suitable for pivotal connection to bracket post means 109 (FIG. 2) on the underside of the platform structure means 23. The movable free end portions of the frameworks 46 and 48 are then conveniently provided with oppositely disposed roller means 71 and 73 (framework 46) and roller means 75 and 77 (framework 48). Each roller means are pivotably supported between suitable spaced tine members, not numbered in the drawing. It is convenient to provide that the roller means 75 and 77 are supported by and to move along the upper surfaces of the bed frame members 32 and 34 (FIG. 5). The roller means 71 and 73 are desirably provisioned to move along and with respect to suitable guide or tracked means (not shown) provided on the underside of the platform structure means 23 according to well understood practice.

Now in accordance with the present invention, the second support structure means 27 is provided, and is provisioned to be pivotably connected on one end portion thereof to the framework 48 and to have the other end portion comprise a free end portion thereof movable against the underside of the platform structure means 23 in response to powered pivotable motion. The second support means 27 includes a first generally U-shaped tubular framework 81 and a second generally U-shaped framework 83. The first framework 81 is pivotably connected to the end frame member 48*d* of the inner positioned framework 48 as by means of the two leg frame portions 85 and 87 being connected through pivot pins to suitable spaced bracket means 86 and 88. The free end portion of the first framework 81 includes spaced roller means 91 and 93, and a base cross-frame member 92 spaced transversely of the leg portions 85 and 87 in a slightly removed position from the spaced roller means 91 and 93.

The first framework 81 has a larger width relative to the width of the second framework 83 in order to provide that the spaced roller means 91 and 93 are relatively wide-set in their engagement of the platform structure means 23. The two leg frame portions 82 and 84 of the second framework 83 are pivotably connected to suitable spaced bracket means 95 (only partially shown in FIG. 1). The free end portion thereof includes roller means 97 pivotably mounted to suitable bracket post means attached to a base cross-frame member 96. So mounted for pivotable attachment to the inner framework 48, the second framework 83 is aligned with its roller means 97 supported by and to move along the upper surface of the centrally disposed bed frame member 36. The spaced roller means 91 and 93 of the first framework 81 are therefore aligned to engage and move along spaced guide or track members 101 and 103 as provided on the underside of the platform structure means 23.

Figure 1A:
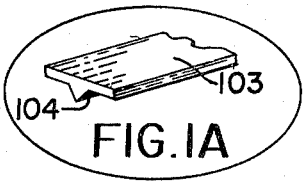
FIG. 1A is an enlarged fragmentary perspective end view of a selected guide member for cooperative use with the pivotable support structure.

FIG. 1A shows in exploded detail the guide member 103, shown to include a centrally disposed protruding rail 104 aligned to be received centrally disposed between the spaced pair of roller means 93. It is readily apparent that the rail 104 comprises means to guide or track the movement of the roller means 93 along the underside of the platform structure means 23. The embodiment of the rail 101 is the same as for the rail 103, and the roller means 91 are thus similarly guided in its movement along the underside of the platform structure means 23. The pivotable movement of the first framework 81 is effected by the provision of electric controlled hydraulic actuation means including at least a single hydraulic cylinder actuator 105 fed by fluid flow line 106. The hydraulic actuator 105 has an inner telescopic expansion post 105*a*, shown fully expanded in FIG. 1. The free end portion of the expandable post 105*a* is provided to be connected to the cross-frame member 92 of the first framework 81 as by pivotable connection to suitable frame bracket means 107. The opposite base end of the hydraulic actuator 105 is to be hinged to bracket means 108 on the cross-frame member 96.

FIG. 2 discloses the platform lift 20 with the loading surface 41 raised to the fully expanded vertical lift position of the first support structure means 25. As stated hereinbefore, the vertical lift of the first support structure means 25 is powered, stabilized and maintained by a fluid-expansion hydraulic actuation means 31. The side view of FIG. 2 depicts the assembly of the apparatus of FIG. 1. In particular, FIG. 2 shows bracket post means 109 depending from the underside of the platform structure means 23 for use in pivotably attaching the framework 48 as heretofore stated. Further, FIG. 2 shows the opposite end portion of the platform loading surface 41 resting on and supported by the roller means 71 of the framework 46. It is readily apparent that the platform structure means 23 by virtue of the pivotal connection of the one end portion thereof at 109-66 is free to be raised from its support by the framework 46, thus comprising an oppositely disposed free end portion for the platform structure means.

Likewise, the framework 46 is pivotably attached to the base structure means 21 through pin connection to the bracket post means 61, and the oppositely disposed end portion of the base structure means 21 provides support for the framework 48 as through the engagement of the roller means 75 upon the bed frame member 32. The pivotable second support frame means 27 is supported by the engagement of the roller means 97 upon the bed frame 36. The physical interconnection of the hydraulic actuator means 105 between the first and second frameworks 81 and 83 and the state or degree of actuation thereof is determinative of the pivotal position of the first framework 81. FIG. 2 shows the hydraulic actuator means 105 in its closed (non-expanded) position and the pivotable second support frame means 27 in its lowered (non-active) position.

FIG. 3 shows the platform lift 20 in its maximum vertical descent position (lowered), and with the free end portion of the platform loading surface 41 being pivoted upwardly about the pivot axis 109-66 in the direction shown at 113. In a manner understood in the art, the hydraulic actuator 105 is activated for outwardly expanding movement of the actuator post 105*a*. The angle of engagement which is formed between the actuator post 105*a* and the first framework 81 is determined so that expansion movement of the actuator post 105*a* causes precipitating pivotable movement of the first framework 81 for angular displacement in the direction shown at 115. The roller means 91 and 93 move upwardly to engage the platform loading surface 41, with the guide rails (104) of the guide means 101 and 103 becoming disposed centrally of the roller means 91 and 93. Continued expansion of the hydraulic actuator post 105*a* forcedly moves the roller means 91 and 93 along the guide means 101 and 103 to angularly rotate the platform loading surface 41 upwardly in the direction shown at 113. The rightmost end portion (as viewed in FIG. 3) of the platform structure means 23 can thus be raised through a desired arc of travel to assume a desired angular lift position whereby cargo loading and unloading is facilitated. If desired, the adjacent side wall 43 can be pivoted for movement onto the aligned edge portion of a loading surface for smoother cargo loading transition onto or off of the platform loading surface 41. Hence, the platform structure means 23 is further movable through means of the second support structure means 27 to predetermined angular lift and descent elevational positions to define another or second elevational position of the adjustable bi-elevational platform lift 20.

FIG. 4 shows the platform lift 20 lowered and the second support structure means 27 in its non-actuated lowered position. In such stored position of the platform lift 20, neither of the hydraulic actuation means 31 or 33 are active for expansion. The platform loading surface 41 is not vertically lifted or angularly lifted, and the roller means 91 or 93 do not engage the platform structure means 23. The second support structure means 27 is supported by engagement of the roller means 97 upon the bed frame member 36.

FIG. 5 is a fragmentary topview of the apparatus of FIG. 4 but with the platform structure means 23 omitted for clarity in the illustration of the apparatus and assembly of the second support structure means 27. Again it is clearly shown the manner in which the roller means 75 and 77 are supported upon the side bed frame members 32 and 34, and the roller means 97 are supported upon the central bed frame member 36. The pivot pin connection 45 is shown enlarged and the upper portion of the framework 46 is omitted for clarity in showing the topview of the free end portion of the framework 48 to which the second support structure means 27 is pivotably attached.

It is clearly shown in FIGS. 4 and 5 that as the first support structure means 25 is raised, the platform structure means 23 will raise to a vertical height beyond which the roller means 91 and 93 would still engage the platform loading surface 41 during actuated pivotal movement of the second support structure means 27. It is for this reason that the platform structure means 23 is only effectively moved to a desired angular lift position with the platform lift 20 in or near its maximum vertical descent position. Suitable electrical interlocks could be provided to prevent the inadvertent dual actuation of the hydraulic actuation means 31 and 33. Further, it is readily seen that as vertical lift of the platform structure means is provided through expansion of the first support structure means 25, the free end portion of the framework 48 will be moved inwardly of the base structure means 21, thus precipitating inwardly directed movement of the second support structure means 27 along the bed frame member 36.

Other alternative equally useful and/or equivalent configurations and mounting arrangements could no doubt be thought of and/or employed to accomplish the intent and purpose of the present invention. It is to be understood that while the present invention has been shown and described with reference to the preferred embodiments thereof, the invention is not limited to the precise forms set forth, and that various modifications and changes may be made therein without departing from the true spirit and scope of the present invention.

I claim:

1. Improved bi-elevational platform lift apparatus including in combination base structure means, first support structure means movably supported with reference to the base structure means and being expandable between predetermined vertical lift and descent positions, platform structure means movably supported upon the first support structure means for movement between said predetermined vertical lift and descent positions, and having one end portion thereof pivotally attached to the first support structure means and the other oppositely disposed end portion thereof comprising a free end portion thereof, first means for actuating vertical lift and descent movements of the first support structure means, second support structure means movably supported with respect to the base structure means and the first support structure means for pivotal movement between predetermined angular lift and descent positions, second means for actuating angular lift and descent movements of the second support structure means, the second support structure means including first framework means pivotally connected to the first support structure means and selectively pivotable between a lowered angular descent position and a raised angular lift position, said second actuation means being connected to the first framework means for actuating the angular lift and descent movements of the first framework means, and further including second framework means connected to the first support structure means and movably supported on and with respect to the base structure means, said second framework means providing another connection for the second actuation means and being moved with respect to the base structure means with actuated vertical lift and descent movements of the first support structure means, and said first framework means being actuable to engage and move against the free end portion of said platform structure means for rotating the platform structure means about the pivotally attached one end portion thereof to a predetermined angular lift position.

2. The improved bi-elevational platform lift apparatus of claim 1 wherein the first framework means is provided with roller means to engage said platform structure means.

3. Improved bi-elevational platform lift apparatus including in combination base structure means, platform structure means selectively movable between predetermined vertical lift and descent elevational positions and between predetermined angular lift and descent elevational positions, expandable first support structure means disposed intermediately of the base structure means and the platform structure means and supportingly engaging oppositely disposed end portions of the platform structure means, one end portion thereof being pivotably attached to the first support structure means and the other end portion thereof comprising a free end portion thereof, said first support structure means being selectively movable between a lowered vertical descent position and a raised vertical lift position, first actuable power means for actuating vertical movement of the first support structure and the platform structure means between vertical lift and descent positions thereof, second support structure means being movably disposed intermediately of the base structure means and the platform structure means, and including first framework means pivotably connected to the first support structure means and movable to engage the platform structure means with the first support structure means in the lowered vertical descent position thereof, said moving engagement pivoting said free end portion with respect to the pivotally attached end portion of the platform structure means for moving between a predetermined lowered angular descent position and a predetermined raised angular lift position of the platform structure means, further including second framework means connected to the first support structure means, said second framework means and said first support structure means including roller means supportingly engaging the base structure means, being movable with respect thereto in response to actuated vertical lift and descent movements of the first support structure means by the first actuable power means, and second actuable power means for actuating pivotal movement of the first framework means and the platform structure means between angular lift and descent positions thereof, and being connected between the first and second framework means to actuate pivotal movement of the first framework means with respect to the second framework means.

4. Improved bi-elevational platform lift apparatus including in combination base structure means, first support structure means movably support with respect to the base structure means and being expandable between predetermined vertical lift and descent positions, platform structure means supported upon the first support structure means and movable together therewith, one end portion thereof being pivotably attached to the first support structure means and the oppositely disposed end portion comprising a free end portion thereof, second support structure means movably supported with respect to the base structure means and including first framework means pivotally connected to the first support structure means and being selectively pivotable between a lowered angular descent position and a raised angular lift position, and further including second framework means pivotally connected to the first support structure means and being movably supported on the base structure means and moving with respect thereto with actuated vertical lift and descent movements of the first support structure means, said first framework means being actuable to engage and move against the free end portion of the platform structure means to cause the platform structure means to pivot with respect to the first support structure means, first means for actuating vertical lift and descent movements of the first support structure means and being connected thereto, and second means for actuating angular lift and descent movements of the second support structure means and being connected between the first framework means and the second framework means, the first framework means including roller means on the free end portion thereof to engage and roll with respect to the platform structure means, and the second framework means including roller means on the free end portion thereof to engage and roll with respect to the base structure means.

* * * * *